US007569785B2

(12) United States Patent
Mills et al.

(10) Patent No.: US 7,569,785 B2
(45) Date of Patent: Aug. 4, 2009

(54) ELECTRICAL SWITCHING APPARATUS INDICATING STATUS THROUGH PANEL APERTURE

(75) Inventors: Patrick W. Mills, Bradenton, FL (US); Kevin D. Gonyea, Bradenton, FL (US); Richard G. Benshoff, Sarasota, FL (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/129,909

(22) Filed: May 16, 2005

(65) Prior Publication Data

US 2006/0254893 A1 Nov. 16, 2006

(51) Int. Cl.
*H01H 9/00* (2006.01)
*H01H 1/52* (2006.01)
*H01H 3/20* (2006.01)

(52) U.S. Cl. ..... 200/313; 200/308

(58) Field of Classification Search ..... 200/313
See application file for complete search history.

(56) References Cited

U.S. PATENT DOCUMENTS

| | | | |
|---|---|---|---|
| 3,329,913 | A | 7/1967 | Camp |
| 3,401,363 | A | 9/1968 | Vyskocil et al. |
| 3,443,258 | A | 5/1969 | Dunham et al. |
| 3,955,162 | A | 5/1976 | Nicol |
| 4,151,386 | A | 4/1979 | Nicol et al. |
| 4,166,989 | A | 9/1979 | Castonguay et al. |
| 4,267,539 | A | 5/1981 | Guinan |
| 4,351,013 | A | 9/1982 | Matsko et al. |
| 4,412,193 | A | 10/1983 | Bienwald et al. |
| 4,568,997 | A | 2/1986 | Bienwald et al. |
| 4,926,148 | A | 5/1990 | Cambreleng |
| 4,963,847 | A | 10/1990 | Cambreleng et al. |
| 5,202,662 | A | 4/1993 | Bienwald et al. |
| 5,224,006 | A | 6/1993 | MacKenzie et al. |
| 5,459,630 | A | 10/1995 | MacKenzie et al. |
| 5,541,800 | A | 7/1996 | Misencik |
| 5,546,266 | A | 8/1996 | Mackenzie et al. |
| 5,691,869 | A | 11/1997 | Engel et al. |
| 5,694,101 | A | 12/1997 | Lavelle et al. |
| 5,831,500 | A | 11/1998 | Turner et al. |
| 5,847,913 | A | 12/1998 | Turner et al. |
| 5,969,920 | A | 10/1999 | Mackenzie |
| 5,981,887 | A | 11/1999 | Robarge et al. |
| 5,982,593 | A | 11/1999 | Kimblin et al. |
| 6,040,967 | A | 3/2000 | DiSalvo |

(Continued)

OTHER PUBLICATIONS

Thermal Aire Technologies, Inc., "Linegard® GFCI Line Cords", 2000, 1 p.

(Continued)

*Primary Examiner*—Elvin G Enad
*Assistant Examiner*—Lheiren Mae A Anglo
(74) *Attorney, Agent, or Firm*—Bradley J. Diedrich

(57) ABSTRACT

An electrical switching apparatus, such as an aircraft circuit breaker or an aerospace circuit breaker, is for a corresponding aircraft or aerospace panel including a first aperture and a second aperture. The circuit breaker includes a status, such as a health status or trip status, a housing adapted to be coupled to the panel, separable contacts and an operating mechanism adapted to open and close the separable contacts. The operating mechanism includes an operating handle adapted to pass through the first panel aperture and a light indicator adapted to be disposed through the second panel aperture to indicate the status of the circuit breaker.

21 Claims, 6 Drawing Sheets

U.S. PATENT DOCUMENTS 6,055,145 A 4/2000 Lagree et al.
6,075,215 A * 6/2000 Bollinger et al. ..... 200/317
6,107,902 A 8/2000 Zhang et al.
6,246,304 B1 6/2001 Gasper
6,365,855 B1 4/2002 Sutter et al.
6,380,501 B1 4/2002 Figueroa et al.
6,392,513 B1 5/2002 Whipple et al.
6,522,228 B2 2/2003 Wellner et al.
6,522,509 B1 2/2003 Engel et al.
6,542,056 B2 * 4/2003 Nerstrom et al. ..... 335/17
6,639,492 B1 10/2003 Hall et al.
6,667,680 B1 * 12/2003 Gibson et al. ..... 336/172
6,697,238 B2 2/2004 Bonilla et al.
6,707,651 B2 3/2004 Elms et al.
6,710,688 B2 3/2004 Wellner et al.
6,727,441 B2 * 4/2004 Benda ..... 200/43.15
6,803,535 B1 10/2004 Whipple et al.
6,864,447 B1 3/2005 Lipsey, II et al.
6,903,289 B2 * 6/2005 Tongo et al. ..... 200/310
6,979,787 B2 * 12/2005 Davies ..... 200/51 R
2004/0056664 A1 3/2004 Macbeth

OTHER PUBLICATIONS

Matthew Halverson, "Leaving a Mark", http://www.keepmedia.com/ShowitemDetails.do?itemID=150908&extID=10032&oliID=213, Aug. 1, 2002, 6 pp.
The National Electrical Safety Foundation (NESF), "Electrical Safety Tips", http://www.shermcoindustriesinc.com/shermcoweb/safety1.htm, 2004, 3 pp.
Hubbell Incorporated, "Circuit Guard®, 15 & 20 Amp Twist-Lock, GFCI Line Cords", http://www.hubbell-wiring.com/library/pressreleases/h4689.pdf, 1999, 4 pp.
Underwriters Laboratories Inc., Request for Comments on Proposed Requirements for the Third Edition of the Standard for Ground-Fault Circuit-Interrupters UL 943; Proposed Effective Date, May 7, 2004, 10 pp.
Fairchild Semiconductor Corporation, "Bipolar T-1 ¾ (5mm) Led Lamp—Diffused", Jul. 26, 2000, pp. 1-4.

* cited by examiner

TEST
GND
COUT
RC0
RC5
VDD
RC2
CIN-
μC
LIGHT INDICATOR
LIGHT INDICATOR
TRIP STATUS
HEALTH STATUS
LATCH
PULSE TRAIN SIGNAL
REG
VIN
VOUT
+5VDC
-VCC
HEALTH STATUS
COIL
N
L

ELECTRICAL SWITCHING APPARATUS INDICATING STATUS THROUGH PANEL APERTURE

BACKGROUND OF THE INVENTION

1. Field of the Invention

This invention relates to electrical switching apparatus and, more particularly, to circuit interrupters, such as, for example, aircraft or aerospace circuit breakers providing arc fault protection.

2. Background Information

Circuit breakers are used to protect electrical circuitry from damage due to an overcurrent condition, such as an overload condition or a relatively high level short circuit or fault condition. In small circuit breakers, commonly referred to as miniature circuit breakers, used for residential and light commercial applications, such protection is typically provided by a thermal-magnetic trip device. This trip device includes a bimetal, which heats and bends in response to a persistent overcurrent condition. The bimetal, in turn, unlatches a spring powered operating mechanism, which opens the separable contacts of the circuit breaker to interrupt current flow in the protected power system.

Subminiature circuit breakers are used, for example, in aircraft or aerospace electrical systems where they not only provide overcurrent protection but also serve as switches for turning equipment on and off. Such circuit breakers must be small to accommodate the high-density layout of circuit breaker panels, which make circuit breakers for numerous circuits accessible to a user. Aircraft electrical systems, for example, usually consist of hundreds of circuit breakers, each of which is used for a circuit protection function as well as a circuit disconnection function through a push-pull handle.

Typically, subminiature circuit breakers have provided protection against persistent overcurrents implemented by a latch triggered by a bimetal responsive to $I^2R$ heating resulting from the overcurrent. There is a growing interest in providing additional protection, and most importantly arc fault protection.

During sporadic arc fault conditions, the overload capability of the circuit breaker will not function since the root-mean-squared (RMS) value of the fault current is too small to actuate the automatic trip circuit. The addition of electronic arc fault sensing to a circuit breaker can add one of the elements required for sputtering arc fault protection—ideally, the output of an electronic arc fault sensing circuit directly trips and, thus, opens the circuit breaker. See, for example, U.S. Pat. Nos. 6,710,688; 6,542,056; 6,522,509; 6,522,228; 5,691,869; and 5,224,006.

Aircraft circuit breakers have employed various mechanisms to indicate fault events. For example, U.S. Pat. No. 6,542,056 discloses a movable and illuminable arc fault indicator having a ring portion and two leg portions internal to a housing. When energized by an arc fault current assembly in response to an arc fault trip condition, an arc fault actuator moves one of the leg portions internal to the housing, which, in turn, moves the ring portion external to the housing. The arc fault current assembly includes a light emitting diode for illuminating the ring portion through the other one of the leg portions when the arc fault current assembly is properly powered and in the absence of an arc fault trip condition.

It has become more and more difficult to incorporate the illuminable ring portion for arc fault indication, since the physical size of aircraft circuit breakers has decreased.

It is known to provide an aircraft circuit breaker including a behind-the-panel indicator to indicate to maintenance personnel the functionality of the circuit breaker electronic components. Hence, the aircraft panel must be opened, with power on, in order to inspect the behind-the-panel indicator. This takes time/cost to inspect, cannot be performed during pre-flight check by the pilot and exposes the maintenance personnel to hazardous voltages.

Accordingly, there is room for improvement in panel-mounted electrical switching apparatus and circuit breakers, which indicate status.

SUMMARY OF THE INVENTION

These needs and others are met by the present invention, which provides an electrical switching apparatus, such as a circuit breaker, for a panel including one or more apertures. The electrical switching apparatus includes one or more light indicators adapted to be disposed through or illuminate through the apertures of the panel to indicate status of the electrical switching apparatus.

In accordance with one aspect of the invention, an electrical switching apparatus is for a panel including a first aperture and a second aperture. The electrical switching apparatus includes a status and comprises: a housing adapted to be coupled to the panel; separable contacts; an operating mechanism adapted to open and close the separable contacts, the operating mechanism including an operating handle adapted to pass through the first aperture of the panel; and a light indicator adapted to be disposed through the second aperture of the panel to indicate the status of the electrical switching apparatus.

The light indicator may be a light source, such as a light emitting diode, which is adapted to be disposed through the second aperture of the panel to indicate the status of the electrical switching apparatus.

The light source may be a light pipe illuminated by a light emitting diode, with the light pipe being adapted to be disposed through the second aperture of the panel to indicate the status of the electrical switching apparatus.

The second aperture of the panel may be a device key-hole.

The status of the electrical switching apparatus may be a health status, such as, for example, a power supply status.

The housing may include a tab adapted to be disposed with the light indicator through the second aperture of the panel.

As another aspect of the invention, an electrical switching apparatus is for a panel including an aperture. The electrical switching apparatus includes a health status and comprises: a housing adapted to be coupled to the panel; separable contacts; an operating mechanism adapted to open and close the separable contacts, the operating mechanism including a transparent operating handle adapted to pass through the aperture of the panel; and a light indicator within the housing, the light indicator adapted to illuminate the transparent operating handle through the aperture of the panel to indicate the health status of the electrical switching apparatus.

As another aspect of the invention, a circuit breaker is for a panel including a first aperture and a second aperture. The circuit breaker includes a health status and a circuit breaker status different than the health status. The circuit breaker comprises: a housing adapted to be coupled to the panel; separable contacts; an operating mechanism adapted to open and close the separable contacts, the operating mechanism including a transparent operating handle adapted to pass through the first aperture of the panel; a trip mechanism cooperating with the operating mechanism to trip open the separable contacts; a first light indicator within the housing, the first light indicator adapted to illuminate the transparent operating handle to indicate the circuit breaker status different than the health status of the circuit breaker; and a second light indicator adapted to be disposed through the second aperture of the panel to indicate the health status of the circuit breaker.

The trip mechanism may include a processor and a power supply, and the health status may indicate whether at least one of the processor and the power supply are functional.

The circuit breaker status may be a trip status, such as, for example, an arc fault trip status.

The trip mechanism may include a power supply, a latch circuit and a processor having a first output with a signal to set the latch circuit in response to the trip status and a second output with a signal to reset the latch circuit in response to a power up condition, the power supply being adapted to power the latch circuit from a line voltage upstream of the separable contacts, the latch circuit being adapted to energize the first light indicator to indicate the trip status.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "light source" expressly includes, but is not limited to, a light emitting diode (LED), a lamp, any other suitable light source, and/or any suitable combination of one or more LEDs, lamps and/or other suitable light sources.

As employed herein, the term "light indicator" expressly includes, but is not limited to, a light source, a light pipe illuminated by a suitable light source, a fiber optic cable illuminated by a suitable light source, one or more fiber optic fibers illuminated by a suitable light source, one or more illuminable members illuminated by a suitable light source, and/or any suitable combination of the forgoing.

As employed herein, the term "trip status" means an arc fault trip condition, a ground fault trip condition, a thermal trip condition, an instantaneous trip condition, a magnetic trip condition, a long delay trip condition, a short delay trip condition, and/or another suitable trip condition of a circuit breaker.

As employed herein, the term "health status" means a power supply status, a line status, a ground status, a neutral status, and/or any suitable diagnostic status of a circuit breaker and/or of one or more circuit breaker components.

As employed herein, the term "circuit breaker status" means a health status, a trip status, an open status, and/or a closed status of a circuit breaker.

The present invention is described in association with an aircraft or aerospace arc fault circuit breaker, although the invention is applicable to a wide range of electrical switching apparatus, such as, for example, circuit interrupters adapted to detect a wide range of faults, such as, for example, arc faults and/or ground faults in power circuits.

Figure 1:
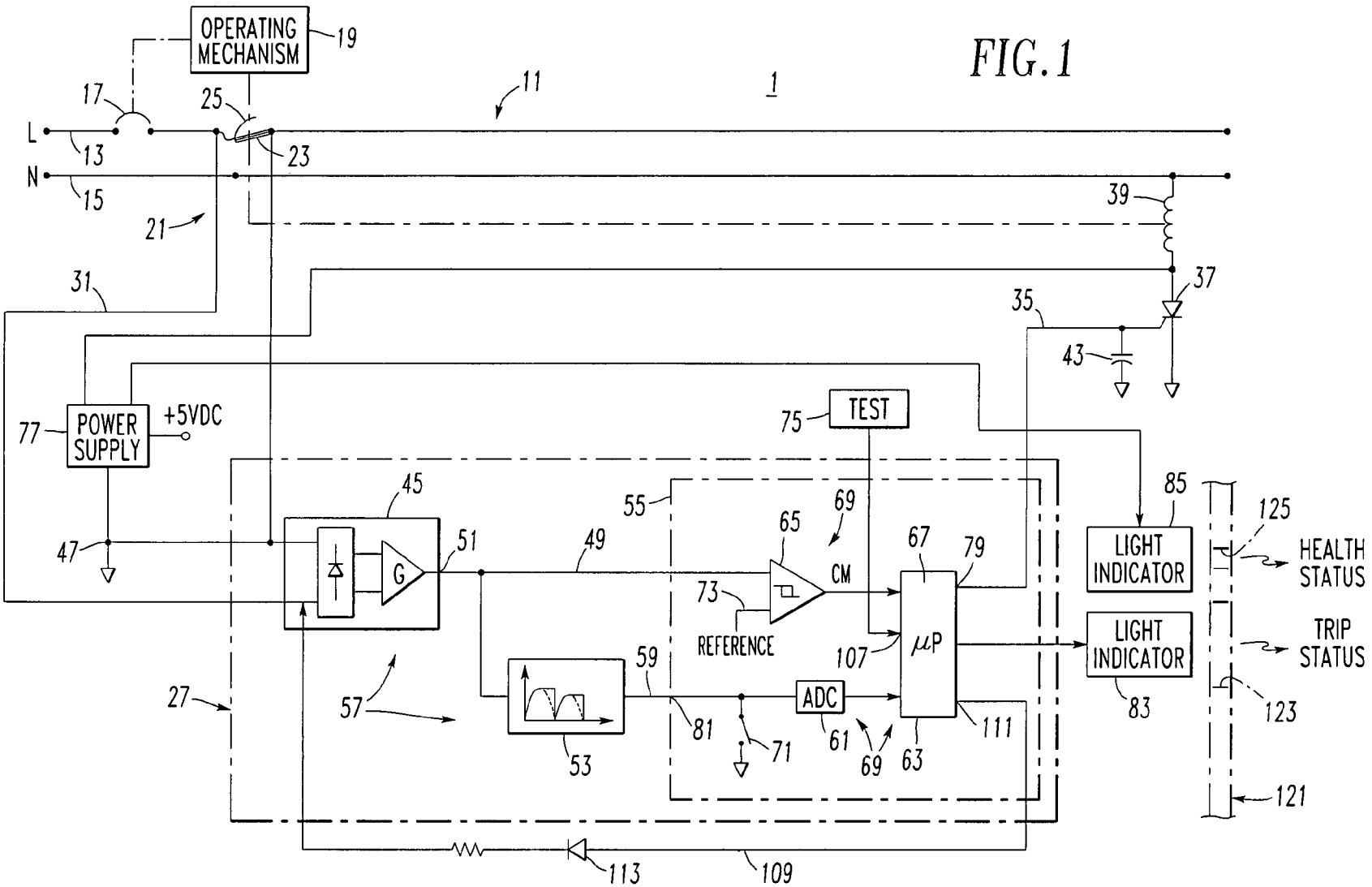
FIG. 1 is a block diagram of an arc fault circuit breaker in accordance with the present invention.

Referring to FIG. 1, an arc fault circuit breaker 1 is connected in an electric power system 11 which has a line conductor (L) 13 and a neutral conductor (N) 15. The circuit breaker 1 includes separable contacts 17 which are electrically connected in the line conductor 13. The separable contacts 17 are opened and closed by an operating mechanism 19. In addition to being operated manually by an operating handle (not shown), the operating mechanism 19 can also be actuated to open the separable contacts 17 by a trip assembly 21. This trip assembly 21 includes the conventional bimetal 23 which is heated by persistent overcurrents and bends to actuate the operating mechanism 19 to open the separable contacts 17. An armature 25 in the trip assembly 21 is attracted by the large magnetic force generated by very high overcurrents to also actuate the operating mechanism 19 and provide an instantaneous trip function.

The circuit breaker trip assembly 21 is also provided with an arc fault detector (AFD) 27. The AFD 27 senses the current in the electrical system 11 by monitoring the voltage across the bimetal 23 through the lead 31 with respect to local ground reference 47. If the AFD 27 detects an arc fault in the electric power system 11, then a trip signal 35 is generated which turns on a switch such as the silicon controlled rectifier (SCR) 37 to energize a trip solenoid 39. The trip solenoid 39 when energized actuates the operating mechanism 19 to open the separable contacts 17. A resistor (not shown) may be disposed in series with the coil of the solenoid 39 to limit the coil current, although such resistor need not be employed. A capacitor 43 protects the gate of the SCR 37 from voltage spikes and false tripping due to noise.

The AFD 27 cooperates with the operating mechanism 19 to trip open the separable contacts 17 in response to an arc fault condition. The AFD 27 includes an active rectifier and gain stage 45, which rectifies and suitably amplifies the voltage across the bimetal 23 through the lead 31 and the local ground reference 47. The active rectifier and gain stage 45 outputs a rectified signal 49 on output 51 representative of the current in the bimetal 23. The rectified signal 49 is input by a peak detector circuit 53 and a microcontroller (μC) 55.

The active rectifier and gain stage 45 and the peak detector circuit 53 form a first circuit 57 adapted to determine a peak amplitude 59 of a rectified alternating current pulse based upon the current flowing in the electric power system 11. The peak amplitude 59 is stored by the peak detector circuit 53.

The μC 55 includes an analog-to-digital converter (ADC) 61, a microprocessor (μP) 63 and a comparator 65. The μP 63 includes one or more arc fault algorithms 67. The ADC 61 converts the analog peak amplitude 59 of the rectified alternating current pulse to a corresponding digital value for input by the μP 63. The μP 63, arc fault algorithm(s) 67 and ADC 61 form a second circuit 69 adapted to determine whether the peak amplitude of the current pulse is greater than a predetermined magnitude. In turn, the algorithm(s) 67 responsively employ the peak amplitude to determine whether an arc fault condition exists in the electric power system 11.

The μP 63 includes an output 71 adapted to reset the peak detector circuit 53. The second circuit 69 also includes the comparator 65 to determine a change of state (or a negative (i.e., negative-going) zero crossing) of the alternating current pulse of the current flowing in the electric power system 11 based upon the rectified signal 49 transitioning from above or below (or from above to below) a suitable reference 73 (e.g., a suitable positive value of slightly greater than zero). Responsive to this negative zero crossing, as determined by the comparator 65, the μP 63 causes the ADC 61 to convert the peak amplitude 59 to a corresponding digital value.

The example arc fault detection method employed by the AFD 27 is "event-driven" in that it is inactive (e.g., dormant) until a current pulse occurs as detected by the comparator 65. When such a current pulse occurs, the algorithm(s) 67 record the peak amplitude 59 of the current pulse as determined by the peak detector circuit 53 and the ADC 61, along with the time since the last current pulse occurred as measured by a timer (not shown) associated with the μP 63. The arc fault detection method then uses the algorithm(s) 67 to process the current amplitude and time information to determine whether a hazardous arc fault condition exists. Although an example AFD method and circuit are shown, the invention is applicable to a wide range of AFD methods and circuits. See, for example, U.S. Pat. Nos. 6,710,688; 6,542,056; 6,522,509; 6,522,228; 5,691,869; and 5,224,006.

A suitable test circuit 75 may be employed to initiate a test of the AFD 27 as will be described.

Figure 2:
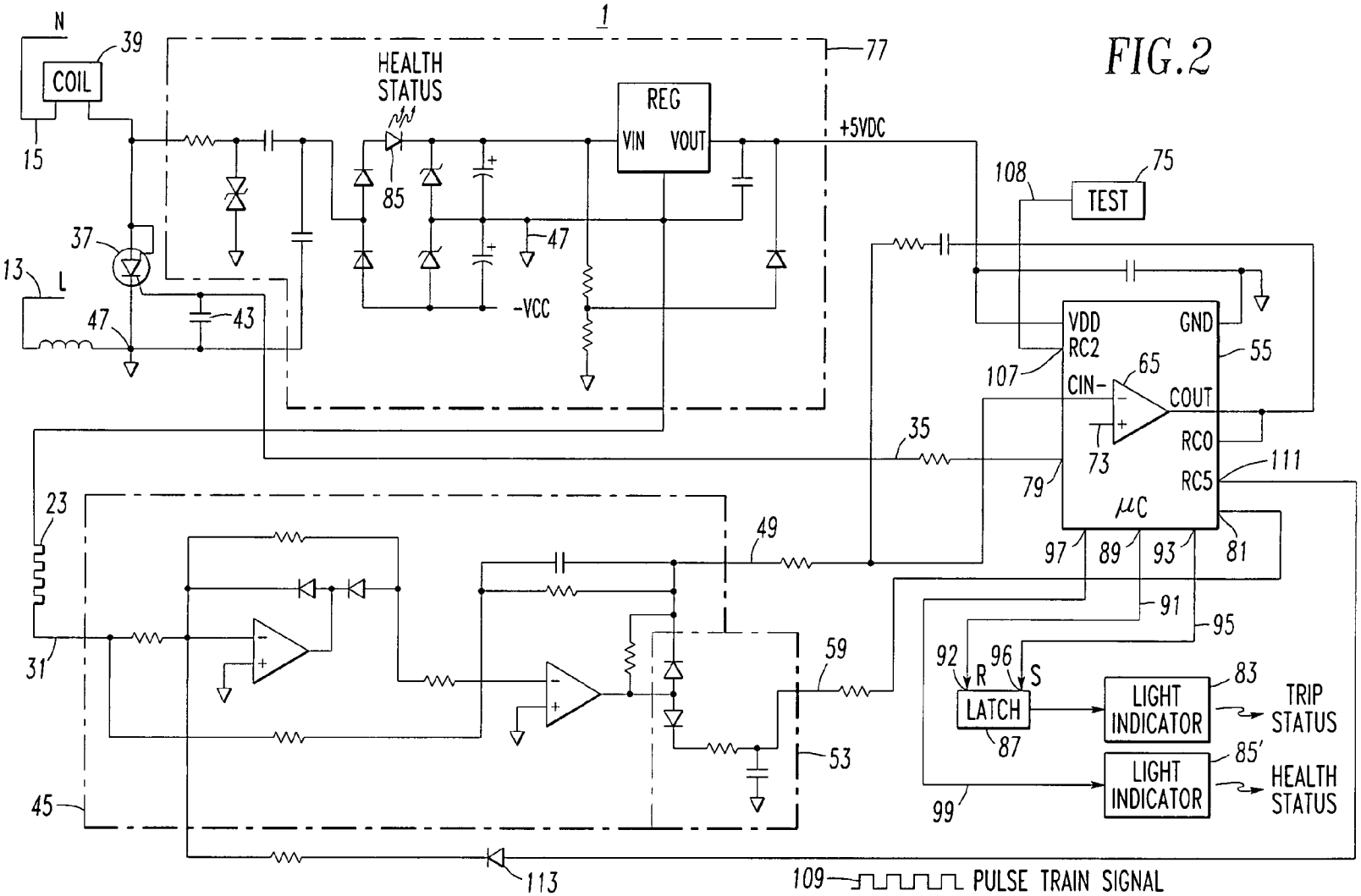
FIG. 2 is a block diagram in schematic form of the processor, power supply, active rectifier and gain stage, peak detector, latch circuit and light indicators of FIG. 1.

FIG. 2 is a block diagram in schematic form of the μC 55, power supply 77, active rectifier and gain stage 45, and peak detector 53 and test circuit 75 of FIG. 1. The μC 55 may be, for example, a suitable processor, such as model PIC16F676 marketed by Microchip Technology Inc. of Chandler, Ariz. A digital output 79 includes the trip signal 35. An analog input 81 receives the peak amplitude 59 for the ADC 61 (FIG. 1). Digital input RC0 of μC 55 is employed to read the output (COUT) of the comparator 65.

As shown in FIGS. 1 and 2, the arc fault circuit breaker 1 also includes a first light indicator (e.g., without limitation, an LED) 83 for a first status (e.g., without limitation, an arc fault trip status) and a second light indicator (e.g., without limitation, an LED) 85 for a second status (e.g., without limitation, a health status). The first light indicator 83 is energized by a reset-set (RS) latch 87. The μP 63 (FIG. 1) has a digital output 89 with a reset signal 91 that is input by a reset input 92 of the RS latch 87, and a digital output 93 with a set signal 95 that is input by a set input 96 of the RS latch 87. Alternatively, the μP 63 may further have a digital output 97 with a status (e.g., without limitation, another health status) signal 99 that energizes another light indicator 85'.

EXAMPLE 1

The first light indicator 83 may be an arc fault trip status LED that is illuminated in response to the detection of an arc fault and the generation of the trip signal 35 by the AFD 27 (FIG. 1).

EXAMPLE 2

The second light indicator 85 may be a health (e.g., functional) LED that indicates the proper function of the AFD 27 including proper powering and grounding, and that the circuit of the trip solenoid 39 is intact.

The power supply 77 generates +5 VDC for the microcontroller (μC) 55, which has the μP 63 (FIG. 1) with the digital output 97 (FIG. 2) that drives the other health LED 85' when the arc fault circuit breaker 1 is properly powered and grounded at the inputs of the power supply 77, and when the circuit of the trip solenoid 39 to the neutral 15 is intact. Alternatively, the other light indicator 85' may indicate that both of the μP 63 and the power supply 77 are functional. The light indicator 85' may be used in addition to or instead of the light indicator 85.

Continuing to refer to FIG. 2, another digital input RC2 107 of μC 55 is employed to input a test signal 108 from the test circuit 75. A further digital output RC5 111 of μC 55 includes a suitable pulse train signal 109 to simulate an arc fault trip condition responsive to the test signal 108. The μC 55, thus, forms an arc fault trip mechanism including the test circuit 75 adapted to simulate an arc fault trip condition to trip open the separable contacts 17 (FIG. 1).

When the μP 63 (FIG. 1) determines that the input 107 is low, it outputs the pulse train signal 109 on output 111. That signal 109 is fed back into the input of the active rectifier and gain stage 45. In turn, the pulse train signal 109 causes the AFD algorithms 67 to determine that there is an arc fault trip condition, albeit a test condition, such that the trip signal 35 is set. A blocking diode 113 is employed to prevent any current from flowing into the μP output 111.

EXAMPLE 3

Figure 3:
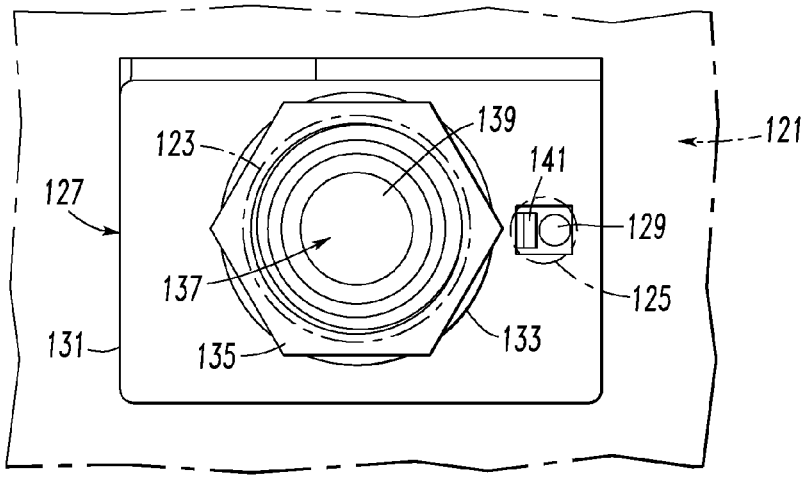
FIG. 3 is a top plan view of a circuit breaker in accordance with another embodiment of the invention as mounted to an aircraft or aerospace panel having two through holes.

FIG. 3 shows a conventional aircraft or aerospace panel 121 (shown in phantom line drawing) including two different apertures, such as through holes 123,125, for mounting of a circuit breaker 127. The circuit breaker 127, which may be the same as or similar to the circuit breaker 1 of FIGS. 1 and 2, includes one or more light indicators 129 (only one light indicator 129 is shown in FIG. 3) through one or both of the holes 123,125 (the light indicator 129 is through the hole 125 of FIG. 3).

The circuit breaker 127 includes a housing 131 adapted to be coupled to the panel 121, which is disposed between a bezel 133 and a nut 135 as is conventional. The circuit breaker 127 also includes an operating mechanism 137 having a push-pull operating handle 139 adapted to pass through the first hole 123 of the panel 121. In accordance with an important aspect of the invention, the light indicator 129 is disposed through the second hole 125 of the panel 121 to indicate a status (e.g., without limitation, a heath status) of the circuit breaker 127. In this example, the second hole 125 is a device key-hole and the circuit breaker housing 131 includes a tab 141 that passes with the light indicator 129 through the second hole 125. Alternatively, the tab 141 need not be employed.

EXAMPLE 4

Figure 6:
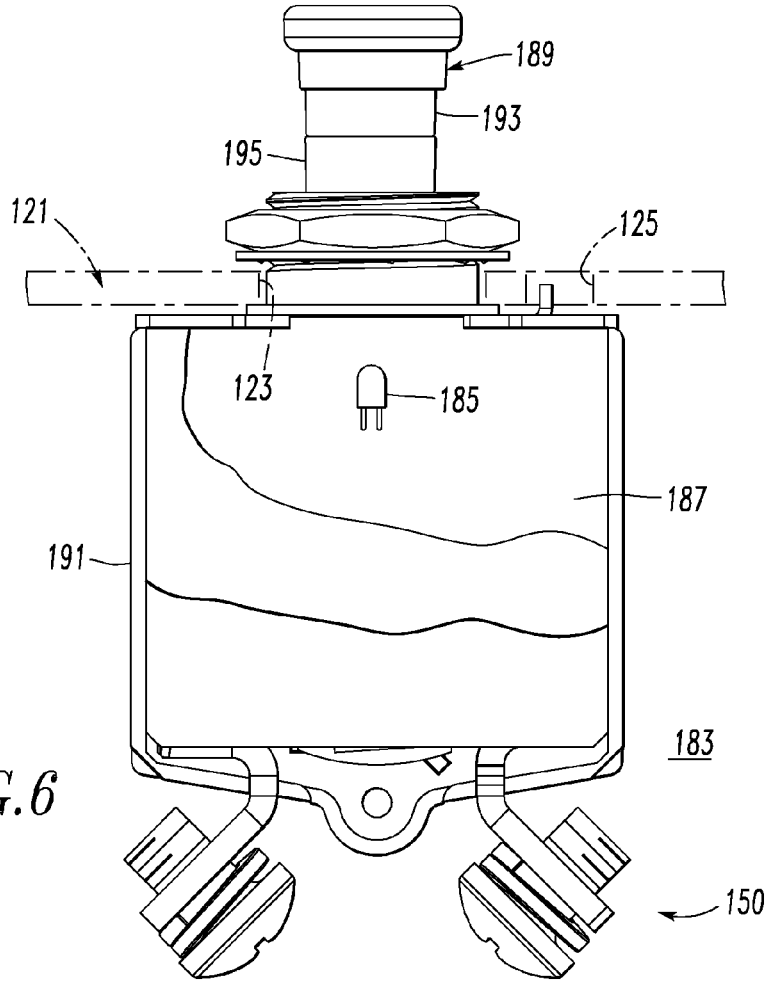
FIG. 6 is a simplified vertical elevation view with some parts cut-away to show internal structures of an aircraft or aerospace circuit breaker incorporating a light indicator and a transparent operating handle in accordance with another embodiment of the invention.
Figure 4:
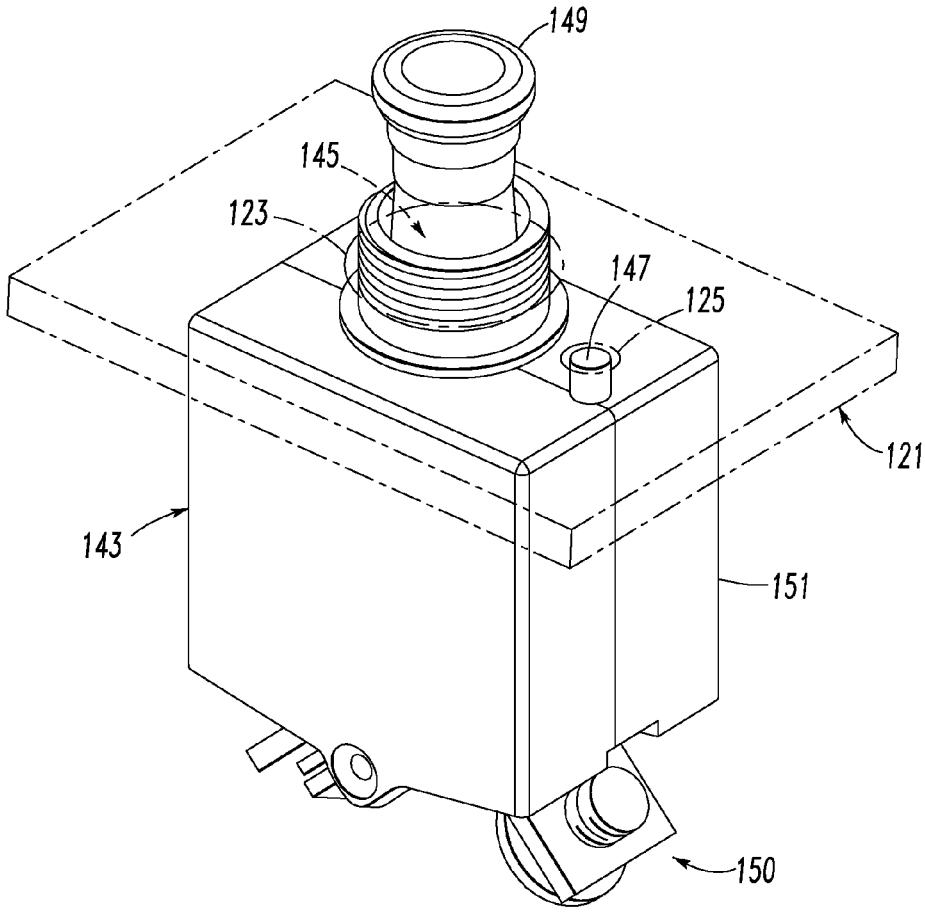
FIG. 4 is an isometric view of an aircraft or aerospace circuit breaker incorporating two light indicators in accordance with another embodiment of the invention.
Figure 7:
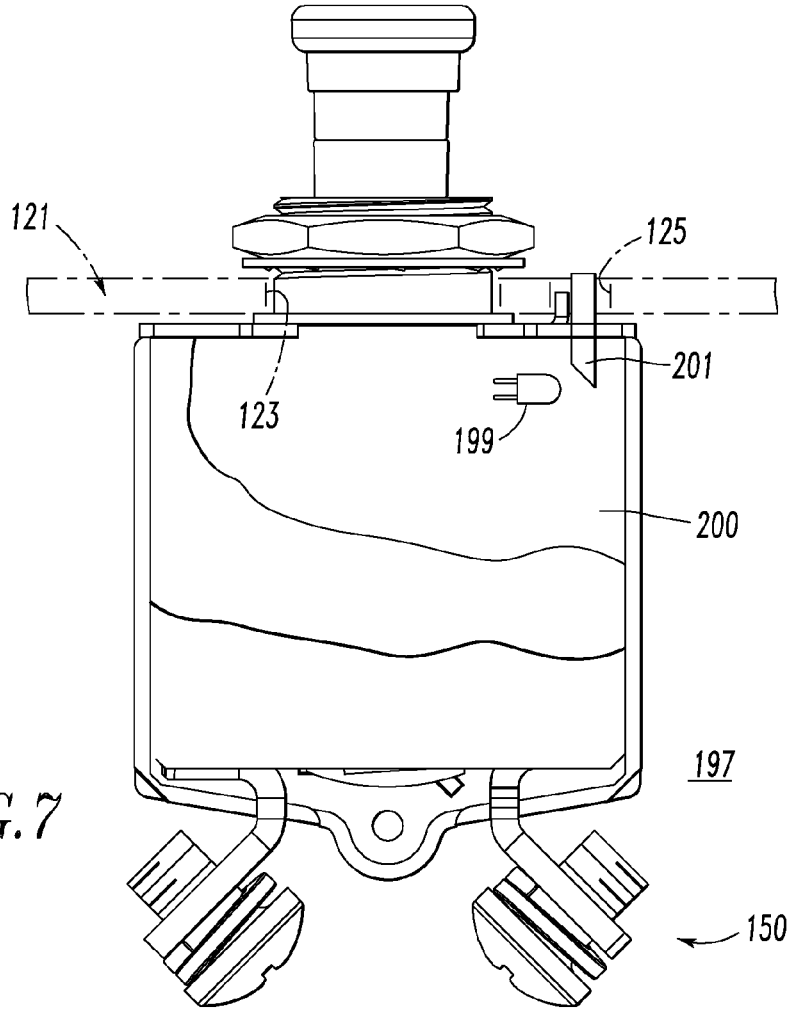
FIG. 7 is a simplified vertical elevation view with some parts cut-away to show internal structures of an aircraft or aerospace circuit breaker incorporating health indication through an LED and a light pipe to illuminate a device keyhole of an aircraft panel in accordance with another embodiment of the invention.

Referring to FIG. 4, another aircraft circuit breaker or aerospace circuit breaker 143, which may be the same as or similar to the circuit breaker 1 of FIGS. 1 and 2 or the circuit breaker 127 of FIG. 3, incorporates two light indicators 145 (e.g., without limitation, an arc fault light indicator) and 147 (e.g., without limitation, a health light indicator). The first light indicator 145 is disposed within a transparent operating handle 149 or within the circuit breaker housing 151. The transparent operating handle 149 passes through the first hole 123 of the panel 121. The first light indicator 145, when energized, illuminates the transparent operating handle 149 to indicate a first status of the circuit breaker 143. The second light indicator 147 passes through the second hole 125 of the panel 121. When energized, the second light indicator 147 indicates a different second status of the circuit breaker 143. A line conductor 150 protrudes from the circuit breaker housing 151 of FIG. 4. FIGS. 6 and 7 include similar structures.

EXAMPLE 5

The second light indicator 147 may indicate a status of the circuit breaker 143, such as a health status (e.g., without limitation, a power supply status). The first light indicator 145 may indicate a circuit breaker status, such as a trip status (e.g., without limitation, an arc fault trip status), that is different than the health status.

EXAMPLE 6

Figure 5:
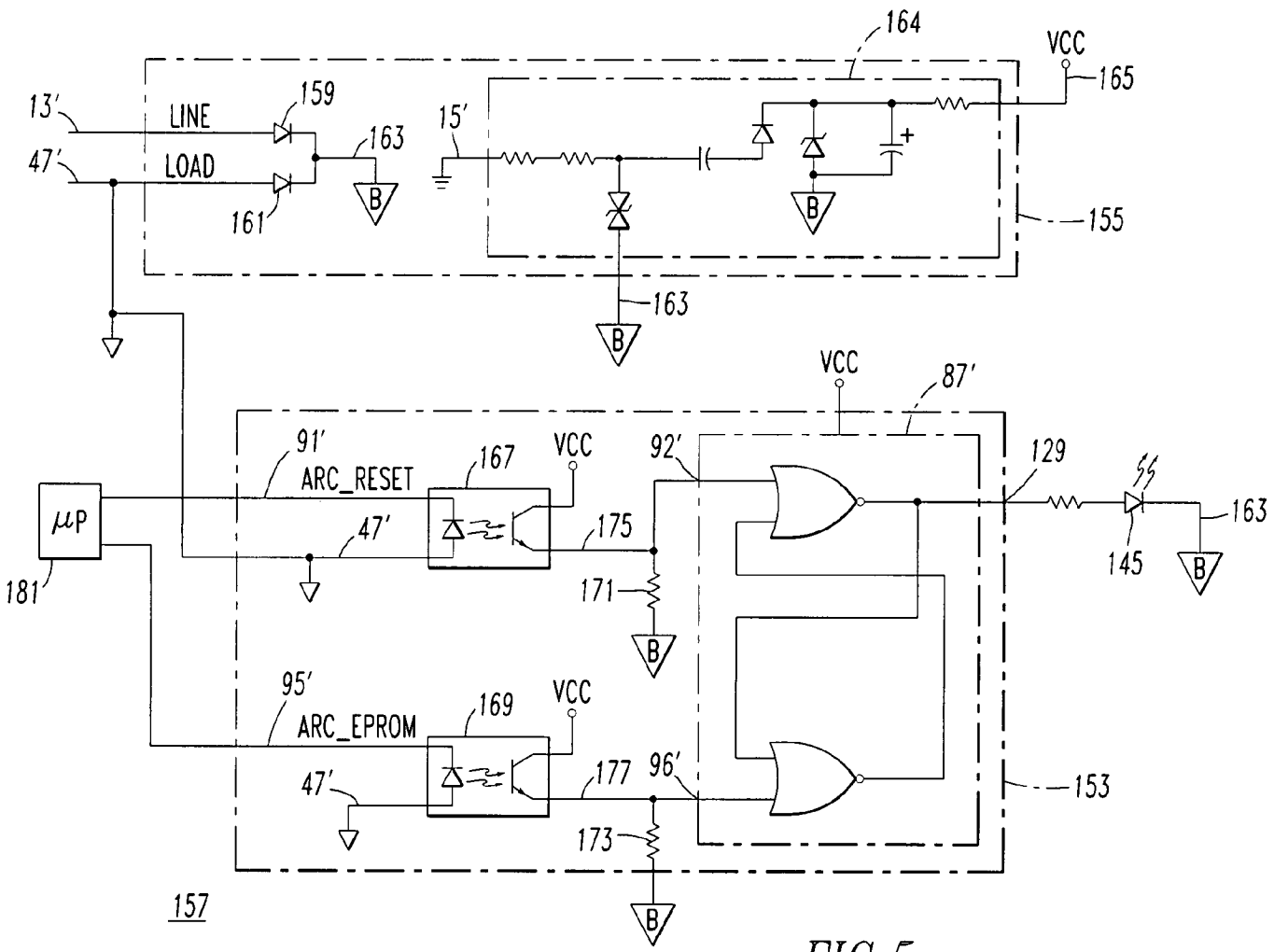
FIG. 5 is a block diagram in schematic form of an arc fault light emitting diode (LED) indication latch circuit and power supply circuit for the aircraft or aerospace circuit breaker of FIG. 4.

FIG. 5 shows an arc fault LED indication latch circuit 153 and a power supply circuit 155 for the circuit breaker 143 of FIG. 4. The circuits 153,155 form part of a trip mechanism 157 that may be the same as or similar to the trip mechanism 21 of FIG. 1. The power supply circuit 155 inputs a line voltage 13' and a load voltage 47' and auctioneers those voltages through respective diodes 159 and 161 to a common reference 163. The power supply circuit 155 employs a suitable AC/DC circuit 164 and outputs a direct current voltage VCC 165, which is derived from a neutral voltage 15' and the common reference 163. The latch circuit 153 includes two optical isolators 167,169, two pull-down resistors 171,173 and an RS latch 87'. The first optical isolator 167 inputs a reset signal 91' (ARC_RESET) and outputs an isolated signal 175 to the pull-down resistor 171 and the reset input 92' of the RS latch 87'. The second optical isolator 169 inputs a set signal 95' (ARC_EPROM) and outputs an isolated signal 177 to the pull-down resistor 173 and the set input 96' of the RS latch 87'. When the output 179 of the RS latch 87' is set, the arc fault LED 145 is energized and illuminated.

The example arc fault light indicator 145 greatly assists ground maintenance personnel in trouble-shooting an arc fault trip event since this indicator remains illuminated until the line voltage 13' is disconnected from the circuit breaker 143 to turn the light indicator 145 off and reset the RS latch 87'. When the circuit breaker 143 trips open, this permits the user to differentiate between an arc fault trip and a thermal (or ground) fault trip.

EXAMPLE 7

For example, a suitable processor (μP) 181 has a first output with the set signal 95' to set the latch circuit 153 in response to an arc fault trip status and a second output with the reset signal 91' to reset the latch circuit 153 in response to a power up condition. The power supply circuit 155 powers the latch circuit 153 from, for example, the line voltage 13' upstream of separable contacts (not shown). The latch circuit 153 energizes the LED 145 to indicate the arc fault trip status.

EXAMPLE 8

The set signal (ARC_EPROM) 95' may be the same as or logically equivalent to the trip signal 35 (FIGS. 1 and 2), which, also, gates the SCR 37 (FIGS. 1 and 2). The trip signal 35 goes high for approximately 25 ms when an arc fault event has been detected. This 25 ms pulse gates the SCR 37 to energize the trip solenoid 39 and, also, turns on the arc fault LED 145 by setting the RS latch 87'.

EXAMPLE 9

In the example latch circuit 153, the initial state of the RS latch 87' is indeterminate until the μP 181 outputs the reset signal 91' to turn the LED 145 off. The RS latch 87' is powered off of the separate power supply circuit 155 that obtains input power from the line voltage 13' and/or the load voltage 47'. When the line voltage 13' is disconnected from the circuit breaker 143 (FIG. 4), this turns the arc fault LED 145 off and resets the RS latch 87'. When the circuit breaker 143 (FIG. 4) trips open, the latch circuit 153 and the LED 145 remain powered. The RS latch 87' keep the arc fault LED 145 on until power is removed from the circuit breaker 143, power is restored to the μP 181, and the μP reset signal 91' resets the RS latch 87'. The pull down resistors 171,173 keep the signals 175,177, respectively, in normally inactive states until the μP 181 asserts one of the respective signals 91',95'.

EXAMPLE 10

FIG. 6 shows an aircraft or aerospace circuit breaker 183 incorporating a suitable light indicator (e.g., without limitation, a health LED) 185 mounted on an internal printed circuit board 187 of the circuit breaker 183. The circuit breaker 183 may be the same as or similar to the circuit breaker 1 of FIGS. 1 and 2. Whenever the light indicator 185 is energized, it floods light internal to the circuit breaker 183, which illuminates the transparent operating handle 189 through the panel hole 123 (shown in phantom line drawing).

EXAMPLE 11

The circuit breaker 183 may have a health (e.g., functional) status, such as a power supply and/or processor status. The light indicator 185 may be an LED within the circuit breaker housing 191, with the LED illuminating the transparent operating handle 189 to indicate the circuit breaker health status.

EXAMPLE 12

The transparent operating handle 189 may include a first colored portion 193 (e.g., a first color, such as, without limitation, white) and a second transparent portion 195. The light indicator 185 may have a second different color (e.g., without limitation, green) to illuminate the second transparent portion 195 in response to the health (e.g., functional) status.

EXAMPLE 13

The transparent operating handle 189 may include a first colored portion 193 (e.g., a first color, such as, without limitation, white) and a second transparent portion 195. The light indicator 185 may have a second different color (e.g., without limitation, red) to illuminate the second transparent portion 195 in response to a trip status (e.g., without limitation, an arc fault trip status).

EXAMPLE 14

FIG. 7 shows an aircraft or aerospace circuit breaker 197 incorporating a suitable light indicator (e.g., without limitation, a health LED) 199 mounted on an internal printed circuit board 200 of the circuit breaker 197. The circuit breaker 197 may be the same as or similar to the circuit breaker 1 of FIGS. 1 and 2. Whenever the light indicator 199 is energized, a suitable light pipe 201 illuminates the device key-hole 125 of the panel 121 (shown in phantom line drawing). The light pipe 201 is advantageously disposed through the panel hole 125 to indicate the status (e.g., without limitation, health) of the circuit breaker 197.

EXAMPLE 15

Figure 8:
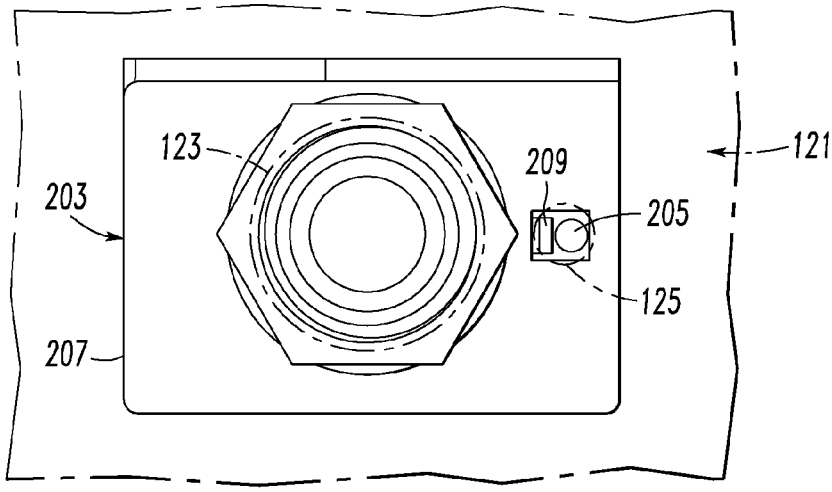
FIG. 8 is a top plan view of an aircraft or aerospace circuit breaker incorporating a light indicator in accordance with another embodiment of the invention.

FIG. 8 shows an aircraft or aerospace circuit breaker 203 incorporating a suitable light indicator (e.g., without limitation, a suitable light source, such as a health LED) 205, which is mounted within (e.g., without limitation, on an internal printed circuit board (not shown)) the circuit breaker 203. The circuit breaker 203 may be the same as or similar to the circuit breaker 1 of FIGS. 1 and 2. Whenever the light indicator 205 is energized, it illuminates the device key-hole 125 of the panel 121 (shown in phantom line drawing). The example LED 205 is disposed through the panel hole 125 to indicate the status (e.g., without limitation, health) of the circuit breaker 203. The circuit breaker 203 includes a housing 207 having a tab 209 disposed with the LED 205 through the panel opening 125.

Providing a front-of-the-panel health indication is superior to employing a behind-the-panel indication, since that structure improves safety and aids in reducing inspection cost and time and, also, provides a simpler mechanism for the flight crew to inspect aircraft circuit breaker functionality during a ground check.

For applications such as, for example, flight critical circuits, the example health light indicator 85 (FIGS. 1 and 2) indicates, when illuminated, that the health (e.g., functionality) of the circuit breaker 1 is intact prior to and during flight.

By using one or both of the existing through holes 123,125 in the aircraft panel 121 for indication, there is a direct retrofit ability for existing aircraft panel designs without the need for costly wiring, fabrication or other modifications.

Although arc fault LEDs are disclosed, any suitable light indicator, such as, for example and without limitation, a ground fault indicator and/or other suitable indicator for an electrical switching apparatus may be employed.

Although an example AFD 27 is shown, it will be appreciated that a combination of one or more of analog, digital and/or processor-based circuits may be employed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus for a panel including a first aperture and a second aperture, said electrical switching apparatus including a status and comprising:

a circuit breaker housing adapted to be coupled to said panel;

a line conductor protruding from said circuit breaker housing;

separable contacts electrically connected in said line conductor;

an operating mechanism adapted to open and close said separable contacts, said operating mechanism including an operating handle adapted to pass through the first aperture of said panel; and a light indicator adapted to be disposed through the second aperture of said panel to indicate the status of said electrical switching apparatus, wherein said light indicator protrudes from said circuit breaker housing.

2. The electrical switching apparatus of claim 1 wherein said light indicator is a light source.

3. The electrical switching apparatus of claim 2 wherein said light source is a light emitting diode, which is adapted to be disposed through the second aperture of said panel to indicate the status of said electrical switching apparatus.

4. The electrical switching apparatus of claim 2 wherein said light source is a light pipe illuminated by a light emitting diode; and wherein said light pipe is adapted to be disposed through the second aperture of said panel to indicate the status of said electrical switching apparatus.

5. The electrical switching apparatus of claim 1 wherein the second aperture of said panel is a device key-hole.

6. The electrical switching apparatus of claim 1 wherein the status of said electrical switching apparatus is a health status.

7. The electrical switching apparatus of claim 6 wherein said health status is a power supply status.

8. The electrical switching apparatus of claim 1 wherein said electrical switching apparatus is a circuit breaker.

9. The electrical switching apparatus of claim 8 wherein said circuit breaker is an aircraft circuit breaker or an aerospace circuit breaker.

10. An electrical switching apparatus for a panel including an aperture, said electrical switching apparatus including a health status and comprising:

a circuit breaker housing adapted to be coupled to said panel;

a line conductor protruding from said circuit breaker housing;

separable contacts electrically connected in said line conductor;

an operating mechanism adapted to open and close said separable contacts, said operating mechanism including a transparent operating handle adapted to pass through the aperture of said panel; and a light indicator within said circuit breaker housing, said light indicator adapted to illuminate the transparent operating handle through the aperture of said panel to indicate the health status of said electrical switching apparatus.

11. The electrical switching apparatus of claim 10 wherein said light indicator is a light source.

12. The electrical switching apparatus of claim 11 wherein said light source is a light emitting diode, which is adapted to illuminate the transparent operating handle.

13. The electrical switching apparatus of claim 10 wherein said health status is a power supply status.

14. A circuit breaker for a panel including a first aperture and a second aperture, said circuit breaker including a health status and a circuit breaker status different than said health status, said circuit breaker comprising:

a circuit breaker housing adapted to be coupled to said panel;

a line conductor protruding from said circuit breaker housing;

separable contacts electrically connected in said line conductor;

an operating mechanism adapted to open and close said separable contacts, said operating mechanism including a transparent operating handle adapted to pass through the first aperture of said panel;

a trip mechanism cooperating with said operating mechanism to trip open said separable contacts;

a first light indicator within said circuit breaker housing, said first light indicator adapted to illuminate the transparent operating handle to indicate the circuit breaker status different than said health status of said circuit breaker; and a second light indicator adapted to be disposed through the second aperture of said panel to indicate the health status of said circuit breaker.

15. The circuit breaker of claim 14 wherein said health status is a power supply status.

16. The circuit breaker of claim 14 wherein said trip mechanism includes a processor and a power supply; and wherein said health status indicates whether at least one of said processor and said power supply are functional.

17. The circuit breaker of claim 14 wherein said circuit breaker status is a trip status.

18. The circuit breaker of claim 17 wherein said trip status is an arc fault trip status.

19. The circuit breaker of claim 17 wherein said trip mechanism includes a power supply, a latch circuit and a processor having a first output with a signal to set said latch circuit in response to said trip status and a second output with a signal to reset said latch circuit in response to a power up condition, said power supply being adapted to power said latch circuit from a line voltage upstream of said separable contacts, said latch circuit being adapted to energize said first light indicator to indicate said trip status.

20. The circuit breaker of claim 14 wherein said second light indicator protrudes from said circuit breaker housing.

21. An electrical switching apparatus for an aircraft or aerospace panel including a first aperture and a second aperture, said electrical switching apparatus including a status and comprising:

a circuit breaker housing adapted to be coupled to said aircraft or aerospace panel;

a line conductor protruding from said circuit breaker housing;

separable contacts electrically connected in said line conductor;

an operating mechanism adapted to open and close said separable contacts, said operating mechanism including an operating handle adapted to pass through the first aperture of said aircraft or aerospace panel; and a light indicator adapted to be disposed through the second aperture of said aircraft or aerospace panel to indicate the status of said electrical switching apparatus, wherein said light indicator protrudes from said circuit breaker housing.

* * * * *